US006198438B1

(12) United States Patent
Herd et al.

(10) Patent No.: US 6,198,438 B1
(45) Date of Patent: Mar. 6, 2001

(54) RECONFIGURABLE MICROSTRIP ANTENNA ARRAY GEOMETRY WHICH UTILIZES MICRO-ELECTRO-MECHANICAL SYSTEM (MEMS) SWITCHES

(75) Inventors: Jeffrey S. Herd, Rowley; Marat Davidovitz, Belmont; Hans Steyskal, Concord, all of MA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/411,714

(22) Filed: Oct. 4, 1999

(51) Int. Cl.[7] ..... H01Q 1/38
(52) U.S. Cl. ..... 343/700 MS; 343/853
(58) Field of Search ..... 343/700 MS, 876, 343/853; 333/105, 262; 361/233, 234; H01Q 1/38

(56) References Cited

U.S. PATENT DOCUMENTS

| | | | | |
|---|---|---|---|---|
| 5,206,655 | * | 4/1993 | Caille et al. | 343/700 MS |
| 5,576,718 | | 11/1996 | Buralli et al. . | |
| 5,578,976 | * | 11/1996 | Yao | 333/262 |
| 5,657,024 | * | 8/1997 | Shingyoji et al. | 342/175 |
| 5,712,643 | | 1/1998 | Skladany . | |
| 5,771,021 | * | 6/1998 | Vehgte et al. | 343/700 MS |
| 5,818,391 | | 10/1998 | Lee . | |
| 5,880,921 | | 3/1999 | Tham et al. . | |
| 6,020,853 | * | 2/2000 | Richards et al. | 343/700 MS |
| 6,061,025 | * | 5/2000 | Jackson et al. | 343/700 MS |

* cited by examiner

*Primary Examiner*—Tho Phan
(74) *Attorney, Agent, or Firm*—William G. Auton

(57) ABSTRACT

A reconfigurable microstrip antenna array geometry which utilizes Micro-Electro-Mechanical System (MEMS) switches to electrically connect groups of printed patch radiators for operation at multiple frequencies.

1 Claim, 1 Drawing Sheet

RECONFIGURABLE MICROSTRIP ANTENNA ARRAY GEOMETRY WHICH UTILIZES MICRO-ELECTRO-MECHANICAL SYSTEM (MEMS) SWITCHES

STATEMENT OF GOVERNMENT INTEREST

The invention described herein may be manufactured and used by or for the Government for governmental purposes without the payment of any royalty thereon.

BACKGROUND OF THE INVENTION

The invention relates generally to antenna arrays, and more specifically, it a new reconfigurable microstrip antenna array geometry which utilizes Micro-Electro-Mechanical System (MEMS) switches to electrically connect groups of printed patch radiators for operation at multiple frequencies.

Recently, there has been considerable effort expended in developing Micro-Electro-Mechanical System (MEMS) switches for operation at microwave frequencies . One of the projected uses for low loss/low power MEMS switches is to reconfigure antenna array apertures for multiple operating functions. Earlier work in tunable microstrip patch antennas exploited pin diodes to control multiple resonant modes via shorting pins. The approach is limited to about a 2:1 operating frequency ratio and operation in an array was not considered. More recently, a planar dipole antenna containing a MEMS series switch in each arm has been developed.

A limiting factor in the aforementioned geometry is the need for approximately a quarter wavelength spacing between the dipole and the ground plane at each operating frequency for useful far field radiation patterns.

The task of providing it a new reconfigurable microstrip antenna array geometry is alleviated by the following U.S. Patents and references, the disclosures of which are incorporated herein by reference:

U.S. Pat. No. 5,880,921 issued to Tham et al;

U.S. Pat. No. 5,818,391, Oct. 6, 1998, Microstrip array antenna, Lee, Choon Sae, Dallas, U.S. Pat. No. 5,712,643, Jan. 27, 1998, Planar microstrip Yagi Antenna array, Skladany, U.S. Pat. No. 5,576,718, Nov. 19, 1996, Thin broadband microstrip array antenna having active and parasitic patches, Buralli, Bernard.

REFERENCES

1 BROWN, R. E.: 'RF-MEMS switches for reconfigurable integrated circuits', IEEE Trans., 1998, MTT-46, pp. 1868–1880.

2 SCHAUBERT, D. H., FARRAR, F. G., SINDORIS, A., and HAYES, S. T.: 'Microstrip antennas with frequency agility and polarization diversity', 1981, AP-29, pp 118–123.

LEE, J. J., ATKINSON, D., LAM, J. J., HACKETT, L., LOHR, R., LARSON, L., LOO, R., MATLOUBIAN, M., TANGENON, G., DE LOS SANTOS, H., and BRUNNER, R.: 'MEMS antenna systems: Concepts, design, and system applications', Nat. Radio Sci. Meeting, Boulder, Clo. 1996.

The Tham reference discloses a monolithically integrated switched capacitor bank using MEMS technology that is capable of handling GHz signal frequencies in both the RF and millimeter bands while maintaining precise digital selection of capacitor levels over a wide tuning range. Each MEMS switch includes a cantilever arm that is affixed to the substrate and extends over a ground line and a gapped signal line. An electrical contact is formed on the bottom of the cantilever arm positioned above and facing the gag in the signal line. A top electrode atop cantilever arm forms a control capacitor structure above the ground line. A capacitor structure, preferably a MEMS capacitor suspended above the substrate at approximately the same height as the cantilever arm, is anchored to the substrate and connected in series with a MEMS switch.

The last three patents disclose Microstrip array antennas.

SUMMARY OF THE INVENTION

The present invention is a new reconfilgurable microstrip antenna array geometry which utilizes Micro-Electro-Mechanical System (MEMS) switches to electrically connect groups of printed patch radiators for operation at multiple frequencies. The MEMS switches serve to control the flow of current between adjacent patches along connecting microstrip lines or along embedded striplines below the antenna ground plane. At the high frequency, all of the switches are in the open state, and the individual patches resonate at a frequency concomitant with the edge length. At the low frequency, all of the switches are in the closed state, and groups of patches are connected electrically to resonate at a lower frequency proportional to the effective edge length.

In the general case, more than two operating frequencies can be achieved by the appropriate choice of patch groupings. Furthermore, the connection between patches can be achieved either by coplanar transmission lines as shown in FIG. 1, or by transmission lines such as stripline below the ground plane of the patches. The patch groupings for each frequency arc selected with approximately one-half wavelength spacing, such that no grating lobes are present over the scan range of the array at that frequency. Each operating frequency requires a separate feed/phasing network, and unused feed probes must be open-circuited to avoid coupling into the other feed networks. Fortunately, the ease of fabrication and control of the MEMS switches makes these requirements achievable.

It is an object of the present invention to provide a new reconfigurable microstrip antenna array geometry which utilizes Micro-Electro-Mechanical System (MEMS) switches to electrically connect groups of printed patch radiators for operation at multiple frequencies. This type of an antenna array is needed for use in a multiple mode space-based radar for weapons control and surveillance.

These objects will become clearer in view of the description provided below.

DESCRIPTION OF THE DRAWINGS

The basic principle is shown in FIG. 1, where the MEMS switches serve to control the flow of current between adjacent patches along connecting microstrip lines or along embedded striplines below the antenna ground plane.

DESCRIPTION OF THE PREFERRED EMBODIMENT

Figure 1:
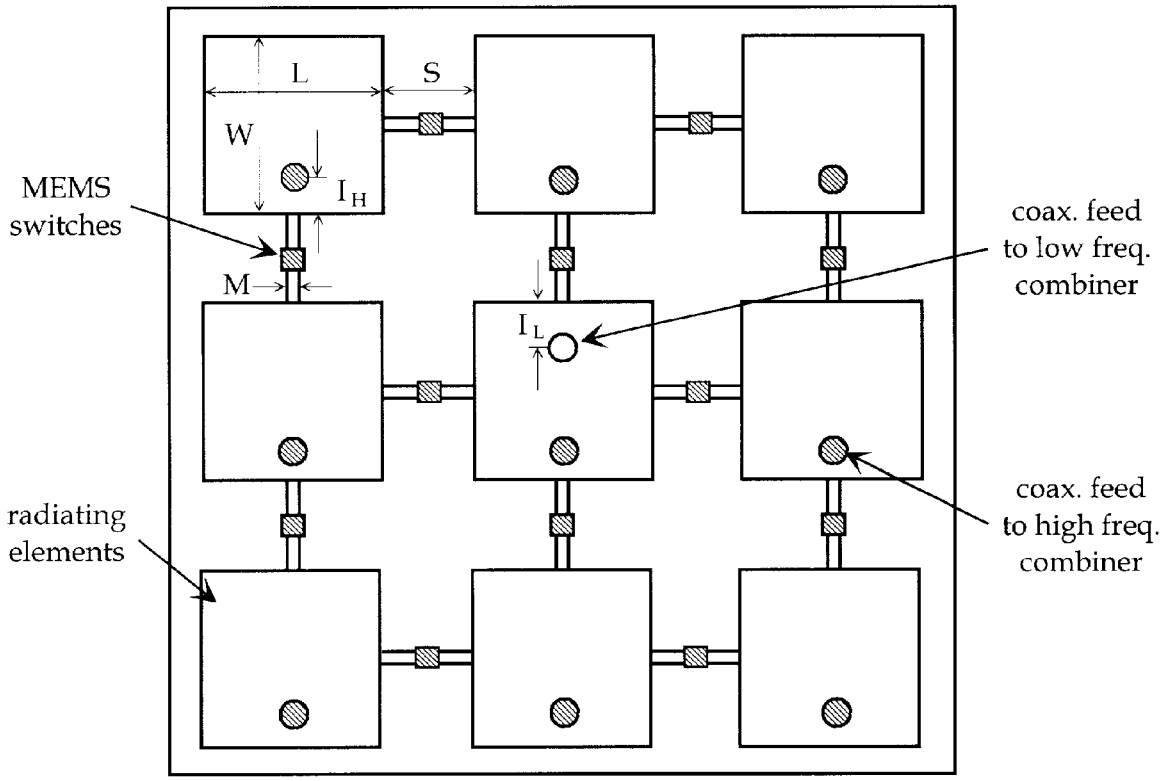

The basic invention consists of a novel antenna array geometry utilizing MEMS switches to electrically connect groups of printed microstrip patches for operation at multiple frequencies. The basic principle is shown in FIG. 1, where the MEMS switches serve to control the flow of current between adjacent patches along connecting microstrip lines or along embedded striplines below the antenna ground plane. At the high frequency, all of the switches are in the open state, and the individual patches resonate at a frequency concomitant with the edge length. At the low frequency, all of the switches are in the closed state, and groups of patches are connected electrically to resonate at a lower frequency proportional to the effective edge length. In the general case, more than two operating frequencies can be achieved by the appropriate choice of patch groupings. Furthermore, the connection between patches can be achieved either by coplanar transmission lines as shown in FIG. 1, or by transmission lines such as stripline below the ground plane of the patches. The patch groupings for each frequency are selected with approximately one-half wavelength spacing, such that no grating lobes are present over the scan range of the array at that frequency. Each operating frequency requires a separate feed/phasing network, and unused feed probes must be open-circuited to avoid coupling into the other feed networks. Fortunately, the ease of fabrication and control of the MEMS switches makes these requirements achievable.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A reconfigurable microstrip antenna array comprising:

groups of printed patch radiators fixed in an antenna array wherein the printed patch radiators are fixed in the antenna array in a rectangular pattern of rows and columns; and a plurality of Micro-Electro-Mechanical System (MEMS) switches fixed in the antenna array to electrically connect the printed patch radiators for operation at multiple frequencies, wherein each Micro-Electro-Mechanical System (MEMS) switch is fixed in the antenna array between the printed patch radiators to electrically connect adjacent printed patch radiators with a Micro-Electro-Mechanical System (MEMS) switch between printed patch radiators in each row and each column.

* * * * *